US008538047B2

(12) United States Patent
Qian et al.

(10) Patent No.: US 8,538,047 B2
(45) Date of Patent: Sep. 17, 2013

(54) DIGITAL SOUND PROJECTOR

(75) Inventors: Li Qian, Beijing (CN); Yu-Quan Wang, Beijing (CN)

(73) Assignee: Beijing FUNATE Innovation Technology Co., Ltd., Beijing (CN)

( * ) Notice: Subject to any disclaimer, the term of this patent is extended or adjusted under 35 U.S.C. 154(b) by 312 days.

(21) Appl. No.: 12/958,163

(22) Filed: Dec. 1, 2010

(65) Prior Publication Data

US 2011/0255717 A1 Oct. 20, 2011

(30) Foreign Application Priority Data

Apr. 14, 2010 (CN) ..... 2010 1 0146847

(51) Int. Cl.
*H04R 25/00* (2006.01)

(52) U.S. Cl.
USPC ..... 381/182; 381/152; 381/431

(58) Field of Classification Search
USPC ..... 381/182, 164, 17, 300–304, 306, 381/309, 333–335, 152, 431
See application file for complete search history.

(56) References Cited

U.S. PATENT DOCUMENTS

| | | | | |
|---|---|---|---|---|
| 3,679,833 | A * | 7/1972 | Inoue | 381/17 |
| 6,243,260 | B1 * | 6/2001 | Lundgren et al. | 361/679.23 |
| 6,577,738 | B2 * | 6/2003 | Norris et al. | 381/77 |
| 6,794,798 | B2 * | 9/2004 | Watanabe et al. | 310/334 |
| 7,343,020 | B2 * | 3/2008 | Thigpen | 381/302 |
| 7,545,946 | B2 * | 6/2009 | Melanson | 381/307 |
| 2006/0126878 | A1 * | 6/2006 | Takumai et al. | 381/335 |
| 2006/0222191 | A1 | 10/2006 | Hung et al. | |
| 2009/0268556 | A1 | 10/2009 | Jiang et al. | |
| 2010/0046774 | A1 * | 2/2010 | Feng et al. | 381/164 |
| 2010/0098272 | A1 | 4/2010 | Jiang et al. | |

FOREIGN PATENT DOCUMENTS

| | | | |
|---|---|---|---|
| CN | 101288338 | | 10/2008 |
| CN | 101594563 | | 12/2009 |
| CN | 101605292 | | 12/2009 |
| JP | 03044298 | A * | 2/1991 |
| WO | WO0123104 | A2 | 4/2001 |

* cited by examiner

*Primary Examiner* — Suhan Ni
(74) *Attorney, Agent, or Firm* — Altis Law Group, Inc.

(57) ABSTRACT

The present disclosure provides a digital sound projector including a first flat speaker, a second flat speaker, a connecting device and a signal input device. The connecting device pivotally connects the first flat speaker and the second flat speaker to form an angle between a surface of the first flat speaker and a surface of the second flat speaker. The angle is larger than 0 degrees and smaller than 180 degrees. The signal input device inputs electrical signals to each of the first and the second flat speakers.

20 Claims, 8 Drawing Sheets

DIGITAL SOUND PROJECTOR

CROSS-REFERENCE TO RELATED APPLICATIONS

This application claims all benefits accruing under 35 U.S.C. §119 from China Patent Application No. 201010146847.2, filed on Apr. 14, 2010, in the China Intellectual Property Office, the contents of which are hereby incorporated by reference. This application is related to application entitled, "DIGITAL SOUND PROJECTOR", filed Nov. 26, 2010 Ser. No 12/954,752.

BACKGROUND

1. Technical Field

The present disclosure relates to a digital sound projector.

2. Description of Related Art

Nowadays, digital sound projectors attract a great attention because the digital sound projector can produce surround sound without complex wires. The digital sound projector includes a panel and a plurality of speakers arranged on a surface of the panel in an array. The digital sound projector delays the time and changes the direction of the sound of the speakers. In the WO0123104A1, a method how to direct sound has been described detailed, and the teachings of which are incorporated by reference. Thus, the sound of the speakers will be focused in at least two directions to form at least two sound beams. Each of the at least two sound beams are spread along a predetermined direction and may be reflected by a wall of a room. The at least two sound beams form a sound source that surrounds a listener.

However, the digital sound projector needs a signal processing device. The signal processing device delays the sound from the speakers to form at least two sound beams from different directions. The structure of the digital sound projector is complex due to the signal processing device.

What is needed, therefore, is a digital sound projector with a simple structure.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
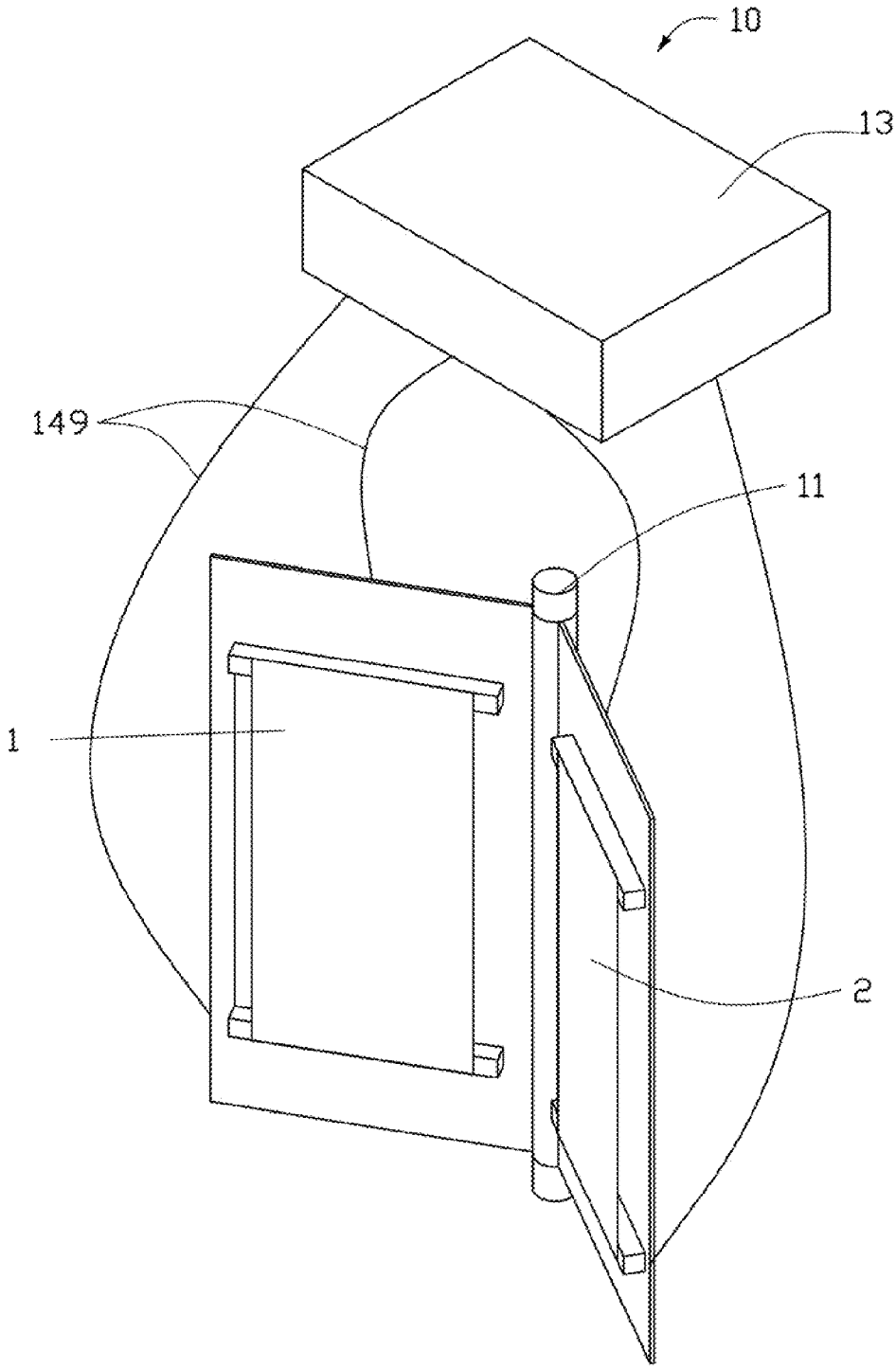
FIG. 1 is a schematic structural view of one embodiment of a digital sound projector.

Referring to FIG. 1, a digital sound projector 10 of one embodiment is illustrated. The digital sound projector 10 includes a first flat speaker 1, a second flat speaker 2, a connecting device 11, and a signal input device 13. The first speaker 1 and the second speaker 2 are pivotally connected to the connecting device 11 and capable of rotating around the connecting device 11. In one embodiment, the connecting device 11 has a hinge configuration. An angle between the first speaker 1 and the second speaker 2 can be changed by rotating the first speaker 1 and the second speaker 2 around the connecting device 11. Both of the first speaker 1 and the second speaker 2 are electrically connected to the signal input device 13. The signal input device 13 inputs independent electrical signals to the first speaker 1 and the second speaker 2. Thus, the first speaker 1 and the second speaker 2 can produce two independent sound beams to form a sound source surrounding the listener.

Figure 2:
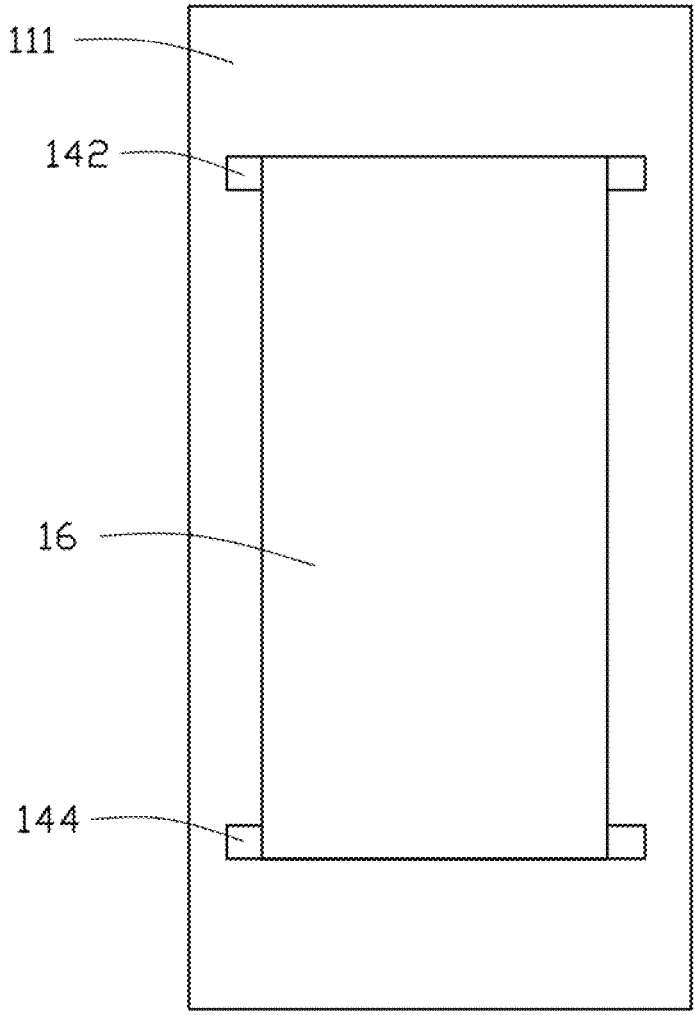
FIG. 2 is a schematic structural view of one embodiment of a first flat speaker of the digital sound projector of FIG. 1.

In one embodiment, a structure of the first speaker 1 is the same as a structure of the second speaker 2. Referring to FIG. 2, the first speaker 1 includes a first electrode 142, a second electrode 144, an insulated panel 111 and an acoustic element 16. The acoustic element 16 contacts and is electrically connected to both the first electrode 142 and the second electrode 144. The first electrode 142 and the second electrode 144 are located on the two opposite flanks of the acoustic element 16. The first electrode 142 and the second electrode 144 are spaced apart from each other and electrically connected to the signal input device 13 by a plurality of conductive wires 149. The signal input device 13 can input electrical signals to the acoustic element 16 through the first electrode 142 and the second electrode 144. The acoustic element 16 transforms the electrical signals into thermal energy via a thermal acoustic effect. The thermal energy heats up surrounding medium, and thus creates sounds.

Figure 3:
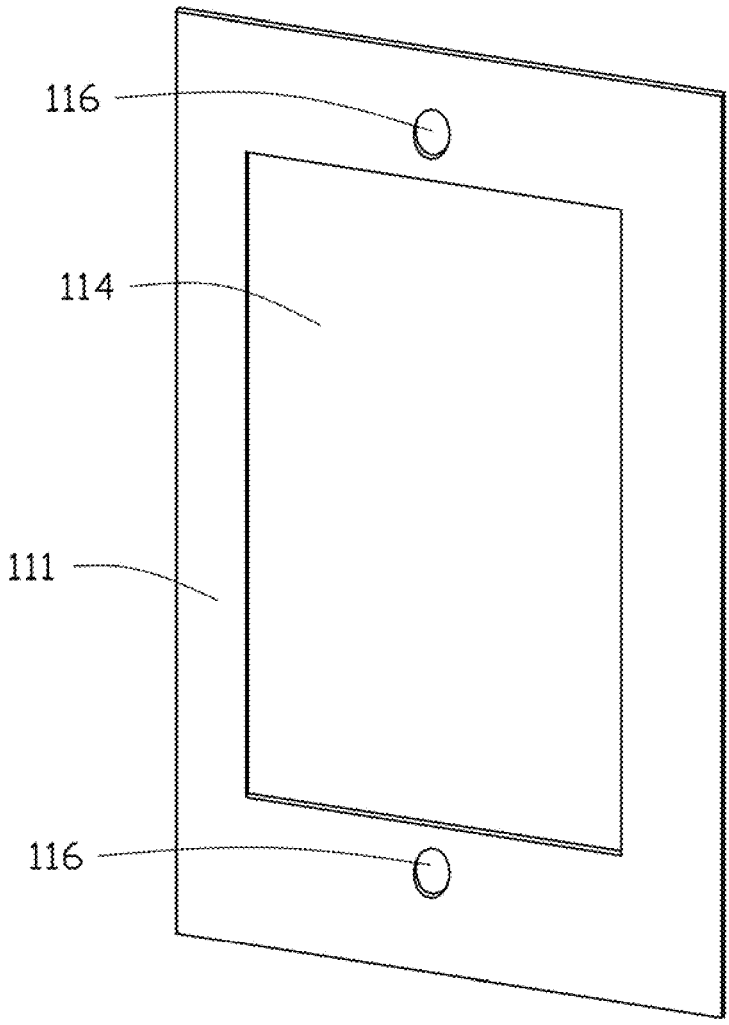
FIG. 3 is a schematic view of one embodiment of a structure of an insulated panel.

Referring to FIG. 3, in one embodiment, the insulated panel 111 can define a first hole 114. A surface of the insulated panel 111 which is configured to face the listener in use is defined as a front surface. A surface of the insulated panel 111 which is opposite to the front surface is defined as a back surface. When the acoustic element 16 is located on the front surface of the insulated panel 111, the first hole 114 can be a through hole or a blind hole on the front surface of the insulated panel 111. When the acoustic element 16 is located on the back surface of the insulated panel 111, the first hole 114 should be a through hole so that the sound beam produced by the first speaker 1 will not be blocked by the insulated panel 111. In one embodiment, the acoustic element 16 is located on the front surface of the insulated panel 111 and the first hole 114 is a through hole. The shape of the first hole 114 is not limited. The shape of each of the first holes 32 can be the same as the shape of the acoustic element 14. In one embodiment, the shape of the first hole 114 is substantially rectangle as is the acoustic element 14. The position of the first hole 114 corresponds to the position of the acoustic element 16. The first electrode 142 and the second electrode 144 are also located on two opposite flanks of the first hole 114. The acoustic element 16 is fastened on the insulated panel 111 by the first electrode 142 and the second electrode 144 in one embodiment. In one embodiment, the acoustic element 16 is located on the front surface of insulated panel 111 and covers the first hole 114. Referring to FIG. 2., a portion of the acoustic element 16 covers the first hole 114. Another portion of acoustic element 16 covers the first electrode 142 and the second electrode 144. At least a portion of the acoustic element 16 is suspended over the first hole 114 in one embodiment. The weight of the insulated panel 111 is lighter because of the first hole 114.

Two second holes 36 may be further defined in the insulated panel 111. Therefore, the conductive wires 149 can connect the first electrode 142 or the second electrode 144 to the signal input device 13 through the second holes 36. Each of the two second holes 36 corresponds to one of the first electrode 142 and the second electrode 144. Because the second holes 36, the length of the conductive wires 149 can be reduced, and the energy conversion efficiency of the first speaker 1 can be improved. The conductive wires 149 can get through the second holes 36 and transfer the electrical signals from the signal input device 13 to the first speaker 1.

In another embodiment, the first electrode 142 and the second electrode 144 are located on the front surface of the insulated panel 111. The acoustic element 16 is located on surfaces of the first electrode 142 and the second electrode 144 away from the insulated panel 111. The acoustic element 16 is suspended by the first electrode 142 and the second electrode 144. No first hole should be defined.

In one embodiment, the acoustic element 16 is a carbon nanotube film structure. The carbon nanotube film structure can be a freestanding structure. The term "freestanding", includes, but is not limited to a structure that does not have to be formed on a surface of a substrate and/or can support its own weight. The carbon nanotube film structure includes at least one carbon nanotube film. If the carbon nanotube film structure includes a plurality of carbon nanotube films, the carbon nanotube films can be stacked. Two adjacent carbon nanotube films are combined by Van der Waals attractive force. An angle between aligned directions of the carbon nanotubes in two adjacent carbon nanotube films can range from about 0 degrees to about 90 degrees ($0° \leqq \alpha \leqq 90°$).

In one embodiment, the carbon nanotube film structure can be a drawn film. The drawn film can be drawn from a carbon nanotube array. Examples of the drawn carbon nanotube film are taught by U.S. Pat. No. 7,045,108 to Jiang et al., and WO 2007015710 to Zhang et al. The drawn carbon nanotube film includes a plurality of carbon nanotubes arranged substantially parallel to a surface of the drawn carbon nanotube film. A large number of the carbon nanotubes in the drawn carbon nanotube film can be oriented along a preferred orientation, meaning that a large number of the carbon nanotubes in the drawn carbon nanotube film are arranged substantially along the same direction. An end of one carbon nanotube is joined to another end of an adjacent carbon nanotube arranged substantially along the same direction by Van der Waals attractive force. The drawn carbon nanotube film is capable of forming a freestanding structure. The successive carbon nanotubes joined end to end by Van der Waals attractive force realizes the freestanding structure of the drawn carbon nanotube film.

Some variations can occur in the orientation of the carbon nanotubes in the drawn carbon nanotube film. Microscopically, the carbon nanotubes oriented substantially along the same direction may not be perfectly aligned in a straight line, and some curve portions may exist. It can be understood that a contact between some carbon nanotubes located substantially side by side and oriented along the same direction cannot be totally excluded.

Figure 4:
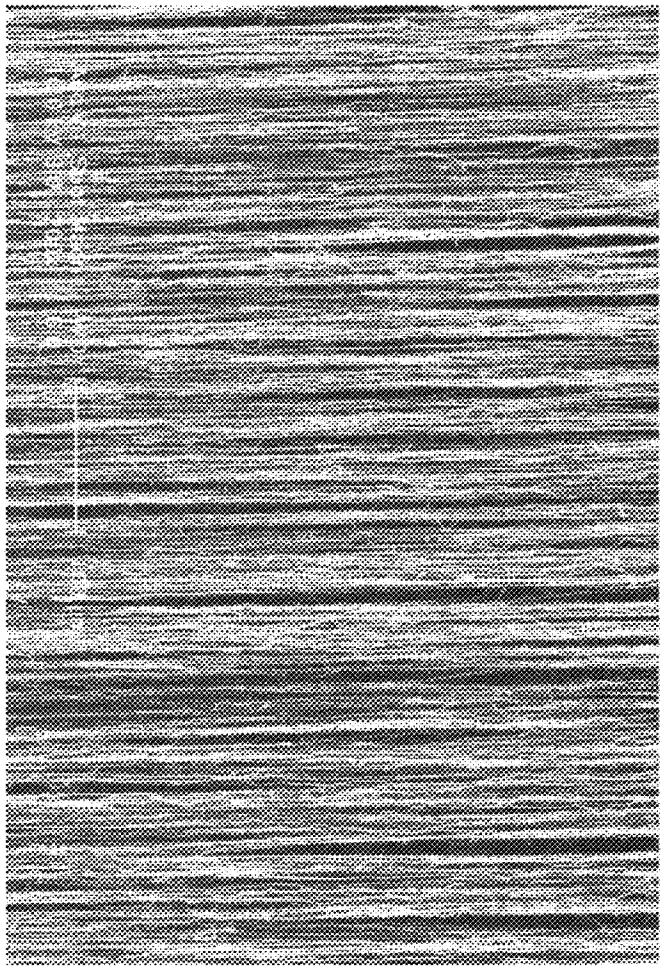
FIG. 4 is a Scanning Electron Microscope (SEM) image of a drawn carbon nanotube film.
Figure 5:
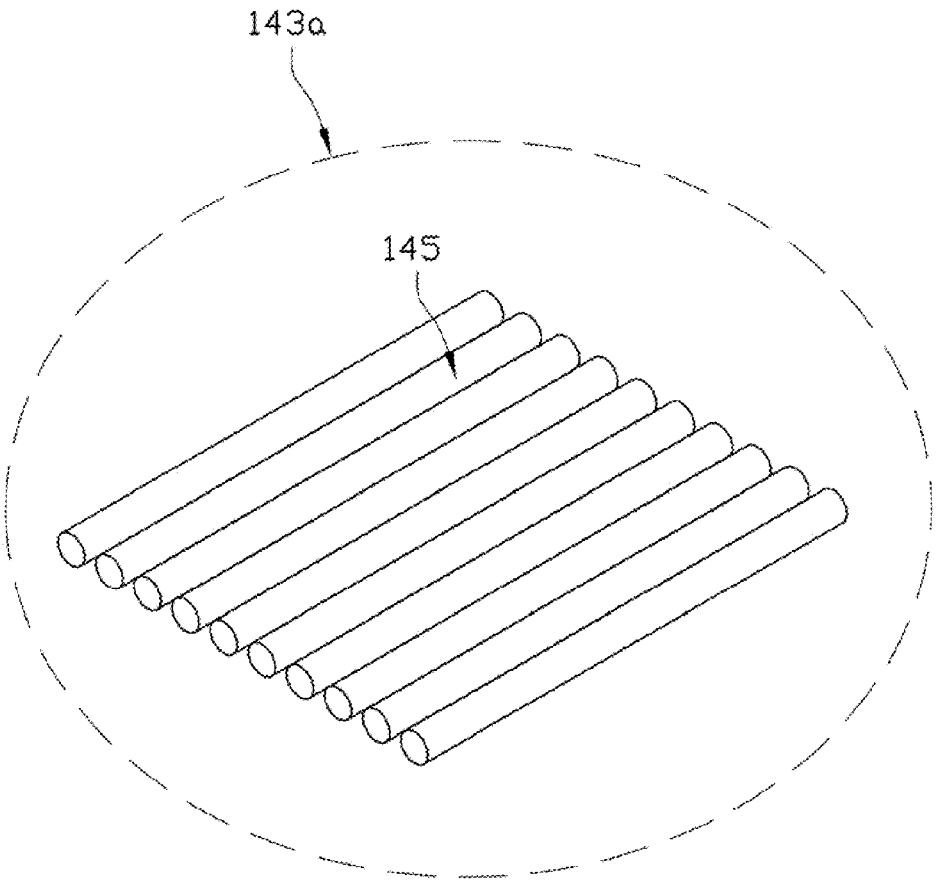
FIG. 5 is a schematic structural view of a carbon nanotube segment of the drawn carbon nanotube film.

Referring to FIG. 4 and FIG. 5, the drawn carbon nanotube film can include a plurality of successively oriented carbon nanotube segments 143*a* joined end-to-end by Van der Waals attractive force therebetween. Each carbon nanotube segment 143*a* includes a plurality of carbon nanotubes 145 substantially parallel to each other, and joined by Van der Waals attractive force therebetween. The carbon nanotube segments 143*a* can vary in width, thickness, uniformity, and shape. A thickness of the drawn carbon nanotube film can range from about 0.5 nm to about 100 μm. Therefore, a thickness of the acoustic element 16 can range from about 0.5 nm to about 1 millimeter. A width of the drawn carbon nanotube film relates to the carbon nanotube array from which the drawn carbon nanotube film is drawn. When the carbon nanotube film structure 104 consist of the drawn carbon nanotube film, and a thickness of the carbon nanotube film structure 104 can be relatively small (e.g., smaller than 10 μm), the carbon nanotube film structure 104 can have a good transparency, and the transmittance of the light can reach about 90%.

In one embodiment, the carbon nanotube film can be a flocculated carbon nanotube film. The flocculated carbon nanotube film can include a plurality of long, curved, disordered carbon nanotubes entangled with each other. A length of each of the carbon nanotubes can be larger than about 10 μm. Further, the flocculated carbon nanotube film can be isotropic. Adjacent carbon nanotubes are acted upon by Van der Waals attractive force to obtain an entangled structure with micropores defined therein. The flocculated carbon nanotube film is very porous. The sizes of the micropores can be less than 10 μm. In one embodiment, the sizes of the micropores are in a range from about 1 nm to about 10 μm. Further, because the carbon nanotubes in the carbon nanotube film structure 104 are entangled with each other, the carbon nanotube film structure 104 employing the flocculated carbon nanotube film has excellent durability, and can be fashioned into desired shapes with a low risk to the integrity of the carbon nanotube film structure 104. The flocculated carbon nanotube film is freestanding because the carbon nanotubes are entangled and are adhered together by Van der Waals attractive force therebetween. The thickness of the flocculated carbon nanotube film can range from about 1 micrometer (μm) to about 1 millimeter (mm). In one embodiment, the thickness of the flocculated carbon nanotube film is about 100 μm. The flocculated carbon nanotube film can be folded into any shape and will not be damaged because the carbon nanotubes in the flocculated carbon nanotube film are entangled with each other.

In another embodiment, the carbon nanotube film includes a plurality of carbon nanotubes arranged along a preferred orientation. The carbon nanotubes are substantially parallel with each other, have substantially equal lengths, and are combined side by side by Van der Waals attractive force therebetween. A length of the carbon nanotubes can reach up to several millimeters. The length of the film can be equal to the length of the carbon nanotubes. Such that at least one carbon nanotube will span the entire length of the carbon nanotube film. The length of the carbon nanotube film is only limited by the length of the carbon nanotubes. In one embodiment, the length of the carbon nanotubes can range from about 1 millimeter to about 30 millimeters. The carbon nanotube films have a plurality of excellent properties, such as electricity conductive property and thermal conductive property.

The heat capacity per unit area of the acoustic element 16 can be less than $2\times10^{-4}$ J/cm$^2$·K. In one embodiment, the heat capacity per unit area of the acoustic element 16 is less than or equal to about $1.7\times10^{-6}$ J/cm$^2$·K. The length and width of the acoustic element 16 is not limited. In one embodiment, the length of the acoustic element 16 is about 3 centimeters, the width of the acoustic element 16 is about 3 centimeters, and the thickness of the acoustic element 16 is about 50 nanometers.

The first electrode 142 and the second electrode 144 are made of conductive material. A shape of the first electrode 142 or the second electrode 144 is not limited and can be lamellar, rod, wire, and block among other shapes. A material of the first electrode 142 or the second electrode 144 can be metals, conductive adhesives, carbon nanotubes, and indium tin oxides among other materials. In one embodiment, the first electrode 142 and the second electrode 144 are rod-shaped metal electrodes. The acoustic element 16 is electrically connected to the first electrode 142 and the second electrode 144. The first electrode 142 and the second electrode 144 can provide structural support for the acoustic element 16. If the acoustic element 16 is composed of a carbon nanotube film structure, the first electrode 142 and the second electrode 144 can be located on the two opposite flanks of the carbon nanotube film structure. The air surrounding the carbon nanotube film structure is heated by the portion of the carbon nanotube film structure suspended between the first electrode 142 and the second electrode 144 to produce sounds. In use, when electrical signals with variations are applied to the carbon nanotube film structure of the acoustic element 16, heating is produced in the carbon nanotube film structure according to the variations of the electrical signal and/or signal strength. Temperature waves, which are propagated into air. The temperature waves produce pressure waves in the air, resulting in sound generation. Because, the carbon nanotube film structure has large specific surface area, the acoustic element 16 can be adhered directly to the first electrode 142 and the second electrode 144. This will result in a good electrical contact between the acoustic element 16 and the first electrode 142 and the second electrode 144.

In other embodiments, a conductive adhesive layer (not shown) can be further provided between the first electrode 142 or the second electrode 144 and the acoustic element 16. The conductive adhesive layer can be applied to the surface of the acoustic element 16. The conductive adhesive layer can be used to provide electrical contact and more adhesion between the first electrode 142 or the second electrode 144 and the acoustic element 16. In one embodiment, the conductive adhesive layer is a layer of silver paste.

The structures of the first and second speakers 1, 2 are not limited to the above-described structure in which the acoustic element 16 is made of the carbon nanotube film structure. Any speaker, which can produce directional sound beams can be used as the first or second speaker 1 or 2.

The connecting device 11 is used to connect the first and the second speakers 1, 2. The first and second speakers 1, 2 are pivotally mounted on the connecting device 11 and capable of rotating around the connecting device 11. The angle is formed between the first and second speakers 1, 2 can vary from about 0 degrees to about 180 degrees. In one embodiment, the angle between the first and second speakers 1, 2 is greater 180 degrees when the digital sound projector 10 is located behind the user. The first angle can not be limited as long as the sounds of the two speaker 1, 2 from a surrounding sounds. The opening of the angle formed between the first and second speakers 1, 2 may be faced to the listener. The structure of the connecting device 11 is not limited. The connecting device 11 is made of an insulated material. In one embodiment, the connecting device is a plastic hinge. The plastic hinge can connect a side of the insulated panel 111 of the first speaker 1 and a side of an insulated panel of the second speaker 2 so that the first and second speaker 1, 2 are insulated from each other.

The signal input device 13 is electrically connected to both the first and second speaker 1, 2. The signal input device 13 is electrically connected to the first electrode 142 and the second electrode 144 through the conductive wires 149. The signal input device 13 can input electrical signals to the acoustic element 16 through the first electrode 142 and the second electrode 144. The way that signal input device 13 connects to the second speaker 1 the same as the way that the signal input device 13 connects to the first speaker.

Figure 6:
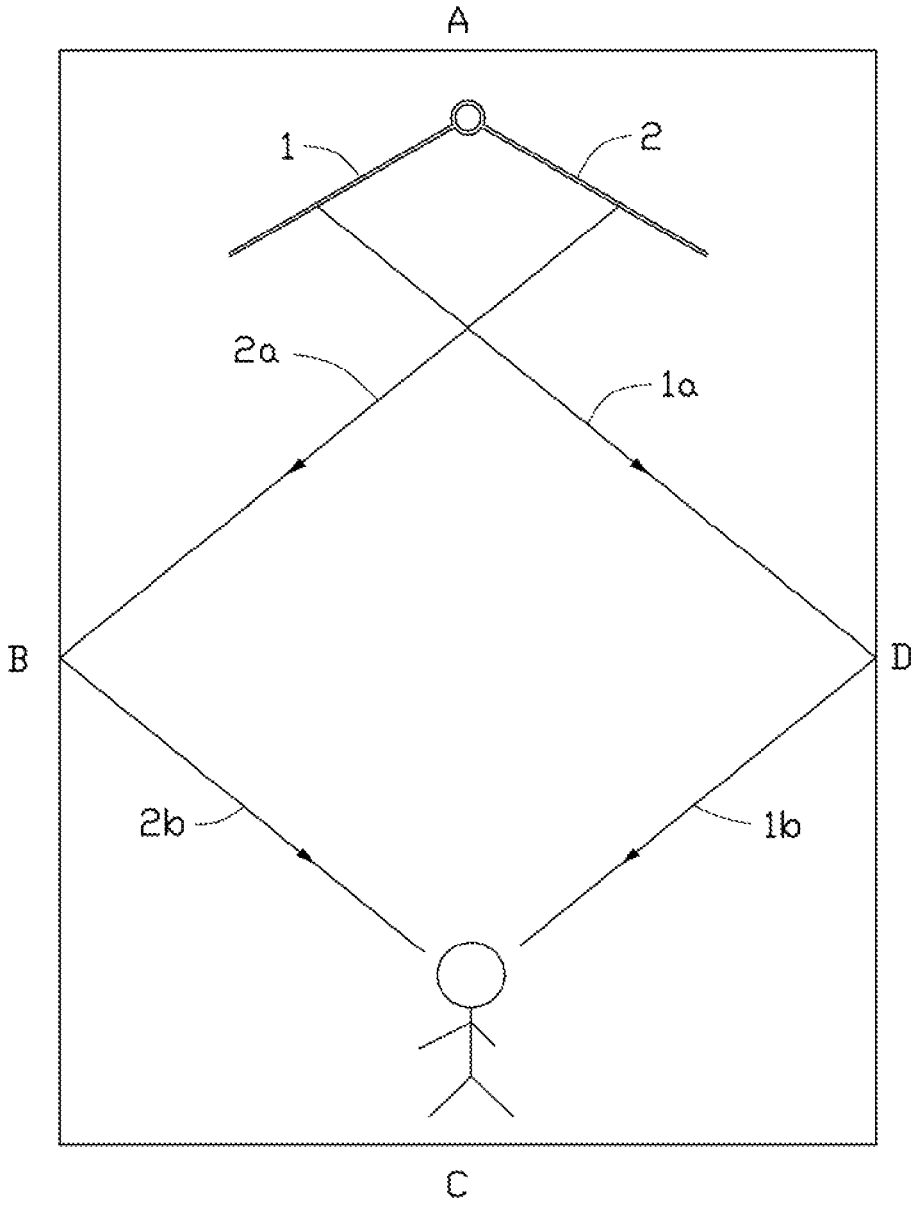
FIG. 6 is a schematic view of one embodiment of a spreading route of sound beams produced by the digital sound projector of FIG. 1.

Referring to FIG. 6, in use, the digital sound projector 10 is located in a room which has four walls. The four walls can be defined as a front wall A, a left wall B, a back wall C, a right wall D. The first speaker 1 and the second speaker 2 are used for the digital sound projector 10. A first sound beam 1*a* that is produced by the first speaker 1 spreads along a direction substantially perpendicular to a surface of the carbon nanotube film structure of the first speaker 1. The first sound beam 1*a* spreads and is reflected by the right wall D to form a first reflected sound beam 1*b*. The first reflected sound beam 1*b* reaches the listener. A second sound beam 2*a* that is produced by the second speaker 2 spreads along a direction substantially perpendicular to the surface of the second speaker 2. The second sound beam 2*a* spreads and is reflected by the left wall B to form a second reflected sound beam 2*b*. The second reflected sound beam 2*b* also reaches the listener. The first reflected sound beam 1*b* and the second reflected sound beam 2*b* form a sound source that surrounds the listener. Therefore, the positions of the first and second speaker 1, 2 are not limited, as long as the sound beams that are produced by the first speaker 1 and the second speaker 2 can reach the listener after being reflected.

The acoustic element 16 is a carbon nanotube film structure. Therefore, the sound beam that is produced by the first speaker 1 or the second speaker 2 spreads along two opposite directions which are substantially perpendicular to the surface of the carbon nanotube film structure. If the insulated panel 111 has a first through hole 32, a portion of sound beams produced by the carbon nanotube film structures will reach the front wall A, a portion of the sound beams produced by the carbon nanotube film structures will reach the listener. In one embodiment, a sound absorbing device (not shown in FIG. 6) can be located between the front wall A and the two speakers 1, 2. The sound absorbing device allows the sounds of the digital sound projector be clearly heard by the listener. If the insulated panel 111 is a plate without a first through hole, the carbon nanotube film structure of the first speaker 1 and the second speaker 2 is opposite to the listener.

Figure 7:
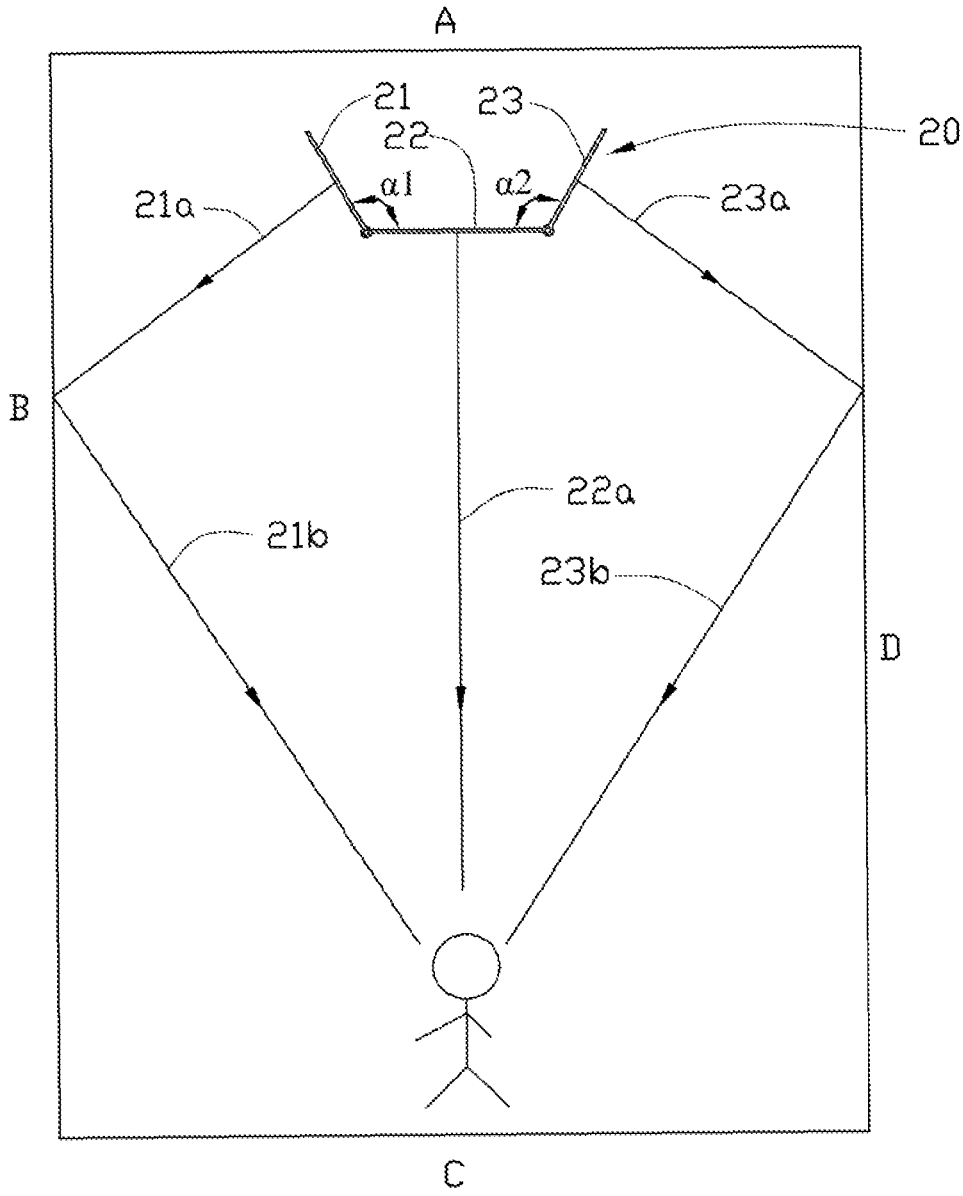
FIG. 7 is a schematic view of one embodiment of a spreading route of sound beams produced by a digital sound projector.

Referring to FIG. 7, one embodiment of a digital sound projector 20 is illustrated. The digital sound projector 20 includes a first flat speaker 21, a second flat speaker 22, a third flat speaker 23, a first connecting device (not labeled), a second connecting device (not labeled) and a signal input device (not shown in FIG. 7). The structure of the first connecting device and the second connecting device is the same as the connecting device 11 of FIG. 1. The first speaker 21, the second speaker 22, and the third speaker 23 are electrically connected to the signal input device. The signal input device inputs independent electrical signals to the first speaker 21, the second speaker 22, and the third speaker 23. Therefore, the first speaker 21, the second speaker 22, and the third speaker 23 can produce sound beams independently. The sound beams produced by the first speaker 21, the second speaker 22, and the third speaker 23 form a sound source surrounding the listener.

The structure of the first speaker 21, the second speaker 22, and the third speaker 23 is the same as the first speaker 1 of FIG. 1. The first speaker 21 and the second speaker 22 are pivotally connected by the first connecting device. The second speaker 22 and the third speaker 23 are pivotally connected by the second connecting device. The first speaker 21 and the third speaker 23 are symmetrical about the second speaker 22. The second speaker 22 faces the listener. A first angle $\alpha 1$ is formed between the first speaker 21 and the second speaker 22 and can vary from about 90 degrees to about 180 degrees. A second angle $\alpha 2$ is formed between the second speaker 22 and the third speaker 23 and can vary from about 90 degrees to about 180 degrees. The first angle $\alpha 1$ and the second angle can not be limited as long as the sounds of the three speaker 21, 22, 23 from a surrounding sounds. The first speaker 21, the second speaker 22, and the third speaker 23 form a bowl type structure. The opening of the bowl type structure is face to the user. The first angle $\alpha 1$ and the second angle $\alpha 2$ can be changed by rotating the three speakers 21, 22, and 23 to obtain maximum acoustical properties of the digital sound projector 20. The distance between the second speaker 22 and the listener can be the shortest, compared with the first speaker 21 and the third speaker 23.

In other embodiments, a motor or other means to rotate the speakers. In other embodiments a remote control may be used to control the rotation means.

In use, the digital sound projector 20 can be located in a room which has four walls. The four walls can be defined as a front wall A, a left wall B, a back wall C and a right wall D. In one embodiment, a carbon nanotube film structure of the first speaker 21 faces the left wall B, a carbon nanotube film structure of the second speaker 22 faces the listener, and a carbon nanotube film structure of the third speaker 23 faces the right wall D. A first sound beam 21*a*, produced by the first speaker 21 spreads along a direction substantially perpendicular to a surface of the carbon nanotube film structure of the first speaker 21. The left wall B, reflects the first sound beam 21*a* to form a first reflected sound beam 21*b*. The first reflected sound beam 21*b* reaches the listener. The second speaker 22 faces the listener, a second sound beam 22*a* produced by the second speaker 22 spreads along the direction substantially perpendicular to a surface of the carbon nanotube film structure of the second speaker 22. The second sound beam 22*a* reaches the listener directly. A third sound beam 23*a* produced by the third speaker 23 spreads along a direction substantially perpendicular to a surface of the third speaker 23. The third sound beam 23*a* spreads and is reflected by the right wall D to form a second reflected sound beam 23*b*. The second reflected sound beam 23*b* reaches the listener. The first reflected sound beam 21*b*, the second sound beam 22*a* and the second reflected sound beam 23*b* form a sound source surrounding the listener.

Figure 8:
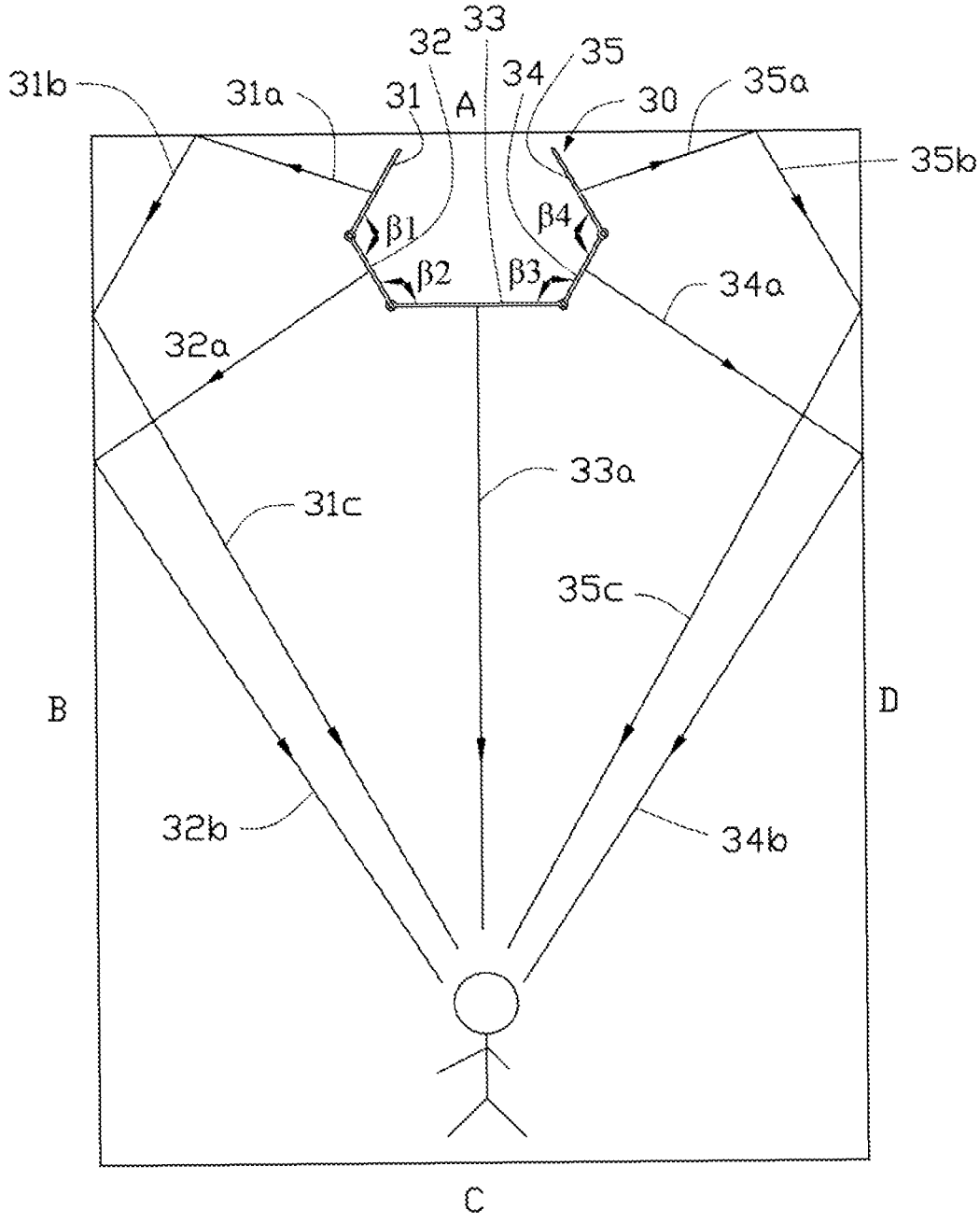
FIG. 8 is a schematic view of one embodiment of a spreading route of sound beams produced by a digital sound projector.

Referring to FIG. 8, a digital sound projector 30 is illustrated in one embodiment. The digital sound projector 30 includes a first flat speaker 31, a second flat speaker 32, a third flat speaker 33, a fourth flat speaker 34, and a fifth flat speaker 35. A first connecting device (not labeled), a second connecting device (not labeled), a third connecting device (not labeled), a fourth connecting device (not labeled) and a signal input device (not shown). The signal input device inputs independent electrical signals to the five speakers 31, 32, 33, 34, and 35. The sound beams produce by the five speakers 31, 32, 33, 34, and 35 forms a sound source surrounding the listener.

Structures of the five speakers 31, 32, 33, 34, and 35 can be the same as the structures of the first flat speaker 1 in FIG. 1. Structures of the three connecting devices of the digital sound projector 30 can be the same as the structure of the connecting device 11 of FIG. 1. The five speakers 31, 32, 33, 34, and 35 are substantially perpendicular to a horizon. The five speakers 31, 32, 33, 34, and 35 are connected in turn by the four connecting devices. The first flat speaker and the second flat speaker are pivotally connected to a first connecting device, the second flat speaker and the third flat speaker are pivotally connected to a second connecting device, the third flat speaker and the fourth speaker are pivotally connected to a third connecting device, the fourth flat speaker and the fifth flat speaker are pivotally connected to a fourth connecting device. A first angle $\beta 1$ formed between the first speaker 31 and the second speaker 32 is less than 180 degrees. The first angle $\beta 1$ can be changed by rotating the first speaker 31 and the second speaker 32. A second angle $\beta 2$ is formed between the second speaker 32 and the third speaker 33 and can vary from 90 degrees to 180 degrees A third angle $\beta 3$ is formed between the third speaker 33 and the fourth speaker 34 and can vary from 90 degrees to 180 degrees. A fourth angle $\beta 4$ is formed between the fourth speaker 34 and the fifth speaker 35 is less than 180 degrees. The sum of the third angle $\beta 3$ and the fourth angle $\beta 4$ is greater than 180 degrees. The first angle $\beta 1$, second angle $\beta 2$. third angle $\beta 3$ and the fourth angle $\beta 4$ can not be limited as long as the sounds produced by the five speaker 31, 32, 33, 34, 35 can form surrounding sounds. The first speaker 31 and the fifth speaker 35 can be symmetrical about the third speaker 33. The second speaker 32 and the fourth speaker 34 can be symmetrical about the third speaker 33. The distance between the third speaker 33 and listener can be the shortest when compared with the other four speakers 31, 32, 34, and 35. The distance between the second speaker 32 and listener and the distance between the fourth speaker 34 and listener can be less when compared with the first speaker 31 and the fifth speaker 35. The distance between the first speaker 31 and listener and the distance between the fifth speaker 35 and listener can be the longest when compared with the second speaker 32, the third speaker 33, and the fourth speaker 34.

In use, the digital sound projector 30 can be located in a room having four walls. The four walls can be defined as a front wall A, a left wall B, a back wall C, and a right wall D. A carbon nanotube film structure of the first speaker 31 faces the front wall A. A carbon nanotube film structure of the second speaker 32 faces the left wall B. A carbon nanotube film structure of the third speaker 33 faces the listener. A carbon nanotube film structure of the fourth speaker 34 faces the right wall D. A carbon nanotube film structure of the fifth speaker 35 faces the front wall A.

A first sound beam 31*a* that is produced by the first speaker 31 spreads and is reflected by the front wall A to form a first reflected sound beam 31*b*. The first reflected sound beam 31*b* spreads and is reflected by the left wall B to form a second reflected sound beam 31*c*. The second reflected sound beam 31*c* reaches the listener. A second sound beam 32*a* that is produced by the second speaker 32 spreads and is reflected by the left wall B to form a third reflected sound beam 32*b*. The third reflected sound beam 32*b* reaches the listener. The third speaker 33 faces the listener. A third sound beam 33*a* that is produced by the third speaker 33 reaches the listener directly. A fourth sound beam 34*a* that is produced by the fourth speaker 34 spreads and is reflected by the right wall D to form a fourth reflected sound beam 34*b*. The fourth reflected sound beam 34*b* reaches the listener. A fifth sound beam 35*a* that is produced by the fifth speaker 35 spreads and is reflected by the front wall A to form a fifth reflected sound beam 35*b*, the fifth reflected sound beam 35*b* spreads and is reflected by the left wall B to form a sixth reflected sound beam 35*c*. The sixth reflected sound beam 35*c* reaches the listener. The second reflected sound beam 31*c*, the third reflected sound beam 32*b*, the third sound beam 33*a*, the fourth reflected sound beam 34*b* and the sixth reflected sound beam 35*c* form a sound source surrounding the listener.

In the digital sound projector provided by the present disclosure, the acoustic element is made of a carbon nanotube film structure, the sound beam that is produced by the carbon nanotube film structure spreads along the direction which is substantially perpendicular to the carbon nanotube film structure. Therefore, the directivity of the sound beam produced by the carbon nanotube film structure is good. The digital sound projector needs no other device to control the delay of the sound beams produced by speakers. Therefore, the structure of the digital sound projector of the present disclosure is simple and the cost is decreased.

Finally, it is to be understood that the above-described embodiments are intended to illustrate rather than limit the disclosure. Variations may be made to the embodiments without departing from the spirit of the disclosure as claimed. Elements associated with any of the above embodiments are envisioned to be associated with any other embodiments. The above-described embodiments illustrate the scope of the disclosure but do not restrict the scope of the disclosure.

What is claimed is:

1. A digital sound projector comprising:

a first flat speaker;

a second flat speaker;

a first connecting device pivotally connecting the first flat speaker and the second flat speaker to form a first angle between the first flat speaker and the second flat speaker, wherein the first angle is larger than 0 degrees and smaller than 180 degrees, wherein each of the first flat speaker and the second flat speaker comprises a first electrode, a second electrode, an insulated panel and an acoustic element, and the acoustic element is suspended above the insulated panel by the first electrode and the second electrode; and a signal input device configured to input electrical signals to each of the first flat speaker and the second flat speaker.

2. The digital sound projector of claim 1, wherein the first connecting device is a hinge.

3. The digital sound projector of claim 1, further comprising a third flat speaker and a second connecting device, wherein the second flat speaker and the third flat speaker are pivotally connected together by the second connecting device.

4. The digital sound projector of claim 3, wherein the first angle is larger than 90 degrees and smaller than 180 degrees; a second angle is formed between the second flat speaker and the third flat speaker is larger than 90 degrees and smaller than 180 degrees.

5. The digital sound projector of claim 1, wherein further comprising a third flat speaker, a fourth flat speaker, a fifth flat speaker, a second connecting device, a third connecting device, and a fourth connecting device, the second flat speaker and the fourth flat speaker are symmetrical about third flat speaker, the second flat speaker is pivotally connected to the third flat speaker by the second connecting device, the third flat speaker is pivotally connected to the fourth speaker by the third connecting device, and the fourth flat speaker is pivotally connected to the fifth flat speaker by the fourth connecting device.

6. The digital sound projector of claim 5, wherein a second angle is formed between the second flat speaker and the third flat speaker; and the second angle is larger than 90 degrees and smaller than 180 degrees, a summation of the first angle and the second angle is greater than 180 degrees, an third angle is formed between the third flat speaker and the fourth flat speaker, and the third angle is greater than 90 degrees and less than 180 degrees, a fourth angle is formed between the fourth flat speaker and the fifth flat speaker, the fourth angle is less than 180 degrees, a summation of the third angle and the fourth angle is greater than 180 degrees.

7. The digital sound projector of claim 1, wherein the acoustic element is electrically connected both to the first electrode and the second electrode and configured to receive a signal from the signal input device and produce sounds.

8. The digital sound projector of claim 7, wherein a heat capacity per unit area of the acoustic element is less than $2\times10^{-4}$ J/cm$^2$·K.

9. The digital sound projector of claim 7, wherein the acoustic element comprises a free-standing carbon nanotube film structure.

10. The digital sound projector of claim 9, wherein a thickness of the free-standing carbon nanotube film structure ranges from about 0.5 nanometers to about 100 micrometers.

11. The digital sound projector of claim 9, wherein the free-standing carbon nanotube film structure comprises a plurality of carbon nanotubes arranged along a same direction.

12. The digital sound projector of claim 9, wherein the free-standing carbon nanotube film structure comprises a plurality of carbon nanotubes entangled with each other.

13. The digital sound projector of claim 9, wherein the free-standing carbon nanotube film structure a plurality of successively oriented carbon nanotube segments joined end-to-end by Van der Waals attractive force therebetween, each carbon nanotube segment comprise a plurality of carbon nanotubes substantially parallel to each other, and joined by Van der Waals attractive force therebetween.

14. The digital sound projector of claim 9, wherein the insulated panel defines a first hole, and the free-standing carbon nanotube film structure is located on the insulated panel and covers the first hole.

15. The digital sound projector of claim 14, wherein the first electrode and the second electrode are located on two flanks of the free-standing carbon nanotube film structure.

16. The digital sound projector of claim 7, wherein the insulated panel defines two second through holes corresponding to one of the first electrode and the second electrode, and further comprises two conductive wires which runs through the two second through holes to connect the first electrode and the second electrode to the signal input device.

17. The digital sound projector of claim 7, wherein the first electrode and the second electrode are directly located on the insulated panel, the acoustic element is located on surfaces of the first electrode and the second electrode far away from the insulated panel.

18. A digital sound projector comprising:

a first flat speaker and a second flat speaker, wherein each of the first flat speaker and the second flat speaker comprises:

a first electrode;

a second electrode;

an insulated panel; and an acoustic element, wherein the acoustic element is electrically connected to both of the first electrode and the second electrode and comprises a carbon nanotube film structure, the carbon nanotube film structure is suspended above the insulated panel; and a connecting device pivotally connecting the first flat speaker and the second flat speaker, wherein an angle is formed between the first flat speaker and the second flat speaker, and the angle is changeable in a range from about 0 degrees to about 180 degrees; and a signal input device configured to input electrical signals to the first flat speaker and the second flat speaker.

19. A digital sound projector comprising:

a plurality of flat speakers, wherein each two adjacent flat speakers of the plurality of flat speakers form an angle changeable in a range from about 0 degrees to about 180 degrees, and each flat speaker comprises an insulated panel and an acoustic element suspending above and spaced from the insulated panel; and a signal input device configured to input electrical signals to the plurality of flat speakers.

20. The digital sound projector of claim 17, wherein the acoustic element is electrically connected to the first electrode and the second electrode, and spaced from the insulated panel.

* * * * *